US006520468B2

(12) United States Patent
Lee et al.

(10) Patent No.: US 6,520,468 B2
(45) Date of Patent: Feb. 18, 2003

(54) SUSPENSION BRACKET FOR SUSPENSION FAN

(75) Inventors: Kwing Wah Lee, Shatin (HK); Xue Qian Fu, Cheng Guan (CN)

(73) Assignee: Using Co., Ltd., Kowloon (HK)

( * ) Notice: Subject to any disclaimer, the term of this patent is extended or adjusted under 35 U.S.C. 154(b) by 0 days.

(21) Appl. No.: 09/920,949

(22) Filed: Aug. 3, 2001

(65) Prior Publication Data

US 2002/0027185 A1 Mar. 7, 2002

(30) Foreign Application Priority Data

Aug. 25, 2000 (CN) ..... 00238051 U

(51) Int. Cl.[7] ..... F16M 13/00
(52) U.S. Cl. ..... 248/343; 416/244 R
(58) Field of Search ..... 248/342, 343, 248/344, 345; 416/244 R

(56) References Cited

U.S. PATENT DOCUMENTS 2,882,005 A * 4/1959 Ramsing ..... 248/343
3,041,035 A * 6/1962 Pascucci ..... 248/342
4,697,777 A * 10/1987 Yang ..... 248/343
5,851,107 A * 12/1998 Wang ..... 403/114
5,947,436 A * 9/1999 Bucher et al. ..... 248/27.1
6,102,663 A * 8/2000 Wang ..... 403/114
6,203,279 B1 * 3/2001 Moody et al. ..... 248/343
6,280,145 B1 * 8/2001 Liu ..... 416/244 R

* cited by examiner

*Primary Examiner*—Ramon O. Ramirez
*Assistant Examiner*—Jon Szumny
(74) *Attorney, Agent, or Firm*—Leydig, Voit & Mayer, Ltd.

(57) ABSTRACT

A suspension bracket for mounting a suspension fan having a fan motor including a motor shaft having an upper end with an enlarged support. The bracket includes a body for fixing on a ceiling, and a mount connected below the body and including a substantially horizontal aperture for engaging the support. The aperture has a side opening for accommodating the motor shaft and allowing the support to be moved laterally to the aperture. The bracket includes a fixing plate for closing the side opening of the aperture to retain the support in with the mount in the aperture.

4 Claims, 1 Drawing Sheet

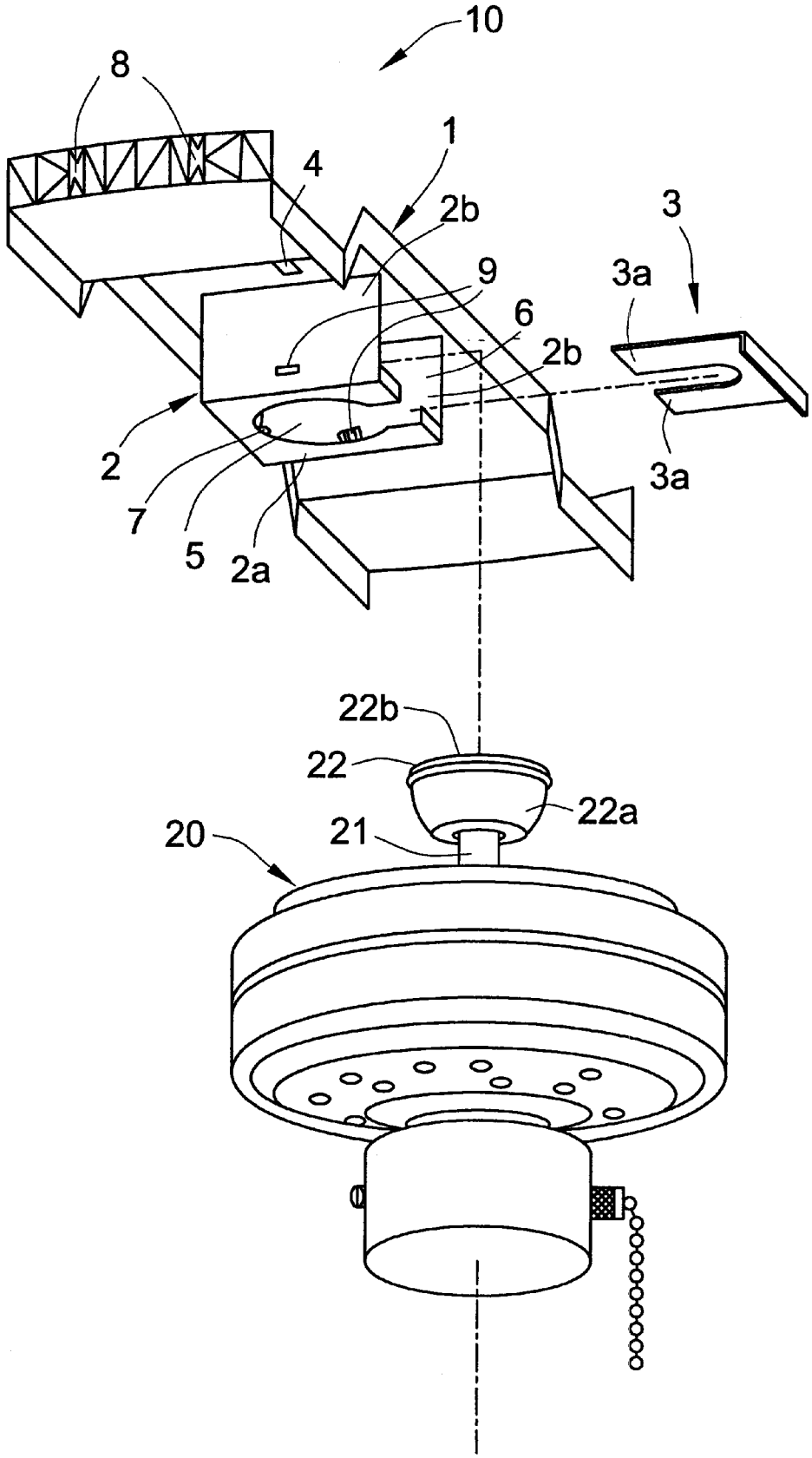
10
8
1
4
2b
3
9
3a
6
2b
2
3a
7
5
2a
22b
22
22a
20
21

SUSPENSION BRACKET FOR SUSPENSION FAN

The present invention relates to a suspension bracket for mounting an electrical ceiling or suspension fan.

BACKGROUND OF THE INVENTION

The pre-existing suspension fans are usually mounted to a ceiling by using a suspension bracket that is initially fixed to the ceiling and then by securing the head, i.e. the part at the upper end of the motor shaft of the fan, to the suspension bracket by means of a plate using screws. This method is found to be inconvenient for both mounting and dismounting a ceiling fan.

The invention seeks to mitigate or at least alleviate such a problem by proving an improved suspension bracket for a suspension fan.

SUMMARY OF THE INVENTION

According to the invention, there is provided a suspension bracket for mounting a suspension fan having a fan motor including a motor shaft having an upper end provided with an enlarged support. The bracket comprises a body for fixing on a ceiling, and a mount connected below the body and formed with a substantially horizontal aperture for engaging said support. The aperture has a side opening for accommodating said motor shaft to allow said support to be moved laterally to the aperture. A fixing member subsequently closes the side opening of the aperture to retain said support in engagement by the aperture.

It is preferred that the aperture of the mount is of a size such that said support is engageable by the rim of and within the aperture.

Preferably, the mount is formed by a plate having a substantially horizontal bottom wall in which the aperture is formed and a pair of opposite side walls connected with the body.

More preferably, the fixing member is insertable into the mount for use, and the side walls of the mount are formed with respective inner protrusions close to the bottom wall to form a pair of opposed gaps with the bottom wall for locating the fixing member.

Further more preferably, the fixing member is in the form of a plate having a pair of bifurcate front ends.

In a preferred embodiment, the aperture is circular and its side opening is relatively narrower.

More preferably, the mount includes a key adjacent the aperture for engaging said support against rotation.

Advantageously, the body has opposite parts formed with holes to allow a hood of said fan to be secured to the body by means of screws to cover the entire bracket.

BRIEF DESCRIPTION OF DRAWING

The invention will now be more particularly described, by way of example only, with reference to the accompanying drawing which is a perspective side and bottom view of an embodiment of a suspension bracket for a suspension fan in accordance with the invention.

DESCRIPTION OF PREFERRED EMBODIMENT

Referring to the drawing, there is shown a suspension bracket 10 embodying the invention for mounting an electric motor 20 of a suspension fan to a ceiling. The bracket 10 comprises a horizontal oblong body 1 including a metal plate folded into a shape that generally resembles a flat letter "W" as shown, a central mount 2 including a rectangular U-shaped metal plate connected centrally to the lower side of the bracket body 1, and a separate metal fixing plate 3.

The fan motor 20 has a vertical shaft 21 and an enlarged suspension ball 22 supporting the shaft 21 by its upper end. The ball 22 has a generally hemispherical body 22A including a peripheral flange 22B around its upper equatorial plane. The suspension fan includes a cover or hood (not shown) for enclosing the entire bracket 10 as well as the ball 22 while the fan motor 20 is suspended, thereby resulting in a neat outlook appearance.

The bracket body 1 has a pair of holes 4 on opposite sides of the central mount 2 so that the body 1 can be secured to the ceiling by means of screws. Each of opposite ends of the bracket body 1 is folded upwards and includes a pair of holes 8 to allow the aforesaid fan hood to be secured to the body 1 at opposite ends with screws.

The central mount 2 has a bottom wall 2A including a circular central aperture 5 which has a diameter slightly larger than the outer diameter of the body 22A (excluding the flange 22B) of the suspension ball 22. The aperture 5 is open on one side laterally of the bracket body 1 to form a relatively narrower opening 6 and is provided on the opposite side with an anti-rotation key 7. Opposite side walls 2B of the mount 2 include, on their inner surfaces and close to the bottom wall 2A, respective protrusions 9 that form a pair of opposed gaps with the bottom wall 2A.

The fixing plate 3 is resiliently deformable and includes a bifurcated side with a pair of front ends 3A. The plate 3 is intended to be inserted into the central mount 2 from the side thereof including the opening 6, at a position with its opposite side edges passing through the opposed gaps between the inner protrusions 9 and the bottom wall 2A.

In use, the suspension bracket 10 is fixed on the ceiling such that the central mount 2 is below the bracket body 1. The fan motor 20 is connected to the bracket 10 by placing the suspension ball 22 laterally into the central mount 2, with the shaft 21 entering into the aperture 5 of the mount 2 through the side opening 6. The opening 6 accommodates the motor shaft 21 while the ball 22 is being moved into the mount 2.

The suspension ball 22 is then turned to align with the anti-rotation key 7 and then lowered into the aperture 5 until its peripheral flange 22B comes into contact with and rests on the rim of the aperture 5, for location through engagement thereby. Subsequently, the fixing plate 3 is inserted into the central mount 2 at a position as described above and immediately above the ball 22, thereby fixing the ball 22 within the aperture 5. The fixing plate 3 closes the side opening 6 of the aperture 5 and preferably bears resiliently against the upper surface of the ball 22 for a secure engagement. Finally, the aforesaid fan hood is installed to conceal the suspension bracket 10 by screws through the holes 8 of the bracket body 1.

In order to dismount the fan motor 20 from the suspension bracket 10, the fan hood is disassembled first and then the fixing piece 3 is pulled out from the central mount 2 to re-open aperture 5, whereupon the suspension ball 22 can be lifted up from the aperture 5 and then removed laterally from the mount 2.

As the suspension bracket 10 does not require the use of any screws to connect the suspension ball 22, mounting and dismounting of the fan motor 20 may be carried out conveniently and quickly. By reason of the ball 22 resting within the aperture 5 of the central mount 2 and being retained by the fixed plate 3, the connection is secure and safe.

The invention has been given by way of example only, and various modifications of and/or alterations to the described embodiment may be made by persons skilled in the art without departing from the scope of the invention as specified in the appended claims.

What is claimed is:

1. A bracket for mounting a ceiling fan, the fan having a fan motor including a shaft extending from a side of the fan opposite a side of the fan including fan blades, and a support on an end of the motor shaft and larger in diameter than the motor shaft, the bracket comprising:

a body having opposed first and second sides, for fixing on a ceiling with the first side adjacent the ceiling;

a mount connected to the second side of the body, the mount including two generally parallel side walls transverse to the body and a bottom wall generally parallel to the body and adjoining the side walls, the bottom wall having a keyhole shaped opening including a generally circular opening and a generally rectangular opening extending from the generally circular opening to an edge of the bottom wall extending between the side walls, the generally rectangular opening being sufficiently wide for passing the motor shaft and the generally circular opening being sized to receive and engage the support to retain the support within the mount, each of the side walls of the mount including a respective protrusion extending into the mount, proximate and spaced from the bottom wall; and a fixing member comprising a plate having a generally circular opening and a generally rectangular opening extending from the generally circular opening to an edge of the fixing member, the generally rectangular and central openings of the fixing member being sized to receive the motor shaft, the plate being slidable into the mount between the respective protrusions and the bottom wall of the mount, clamping a fan support in the mount between the bottom wall and the fixing member.

2. The bracket as claimed in claim 1 wherein the fixing member includes a flange transverse to the plate, at a side of the fixing member opposite the rectangular opening, the flange of the fixing member closing the substantially rectangular opening of the keyhole shaped opening in the bottom wall of the mount when the fixing member is in the mount clamping a fan support.

3. The bracket as claimed in claim 1, wherein the keyhole shaped opening in the bottom wall of the mount includes a key at an edge of the generally circular opening of the keyhole opening for engaging the support to prevent rotation of the support.

4. The bracket as claimed in claim 1, wherein the body has parts at opposite ends, generally transverse to the first and second surfaces, and including holes for securing a hood of the fan to the body to cover the bracket.

* * * * *